US007573401B2

(12) United States Patent
Wabeke

(10) Patent No.: US 7,573,401 B2
(45) Date of Patent: Aug. 11, 2009

(54) HIGHWAY INTERSECTION HAZARD WARNINGS AND TRAFFIC CONTROL SYSTEM, AND METHOD OF APPLYING SAME

(76) Inventor: Roger L. Wabeke, Chemical Risk Management, Eight Windham La., Dearborn, MI (US) 48120

( * ) Notice: Subject to any disclaimer, the term of this patent is extended or adjusted under 35 U.S.C. 154(b) by 318 days.

(21) Appl. No.: 11/796,283

(22) Filed: Apr. 27, 2007

(65) Prior Publication Data

US 2009/0051567 A1 Feb. 26, 2009

(51) Int. Cl.
*G08G 1/095* (2006.01)

(52) U.S. Cl. ..... 340/907; 340/904; 340/908

(58) Field of Classification Search ..... None
See application file for complete search history.

(56) References Cited

U.S. PATENT DOCUMENTS

| | | | | | |
|---|---|---|---|---|---|
| 1,682,753 | A * | 9/1928 | Harris | ..... | 340/930 |
| 3,144,633 | A * | 8/1964 | Germain | ..... | 340/928 |
| 3,983,532 | A | 9/1976 | Hayes | | |
| 5,517,395 | A | 5/1996 | Weissman | | |
| 5,726,648 | A * | 3/1998 | Soon | ..... | 340/929 |
| 5,838,260 | A | 11/1998 | Liu | | |
| 6,072,407 | A | 6/2000 | Shin | | |
| 6,762,689 | B2 | 7/2004 | Dechape | | |
| 6,943,698 | B2 | 9/2005 | Jones et al. | | |
| 7,443,315 | B2 * | 10/2008 | Lo | ..... | 340/907 |
| 2005/0231385 | A1 * | 10/2005 | Haase | ..... | 340/905 |
| 2006/0022838 | A1 | 2/2006 | Fisher | | |
| 2007/0257817 | A1 * | 11/2007 | Mahoney | ..... | 340/929 |

* cited by examiner

*Primary Examiner*—Daniel Wu
*Assistant Examiner*—Brian Wilson
(74) *Attorney, Agent, or Firm*—Law Office of J.D. Pemberton

(57) ABSTRACT

A hazard warning and traffic control system includes a housing having at least two display faces oriented at an angle relative to one another, and an electronic controller including a timer. Each of the display faces contains multiple fields, and each of the fields includes many illuminating members. Each of the fields can be selectively lit, and can display indicia. The controller selectively illuminates the illuminating members to change the display at timed intervals. Each of the display faces includes a STOP field, a DANGER field, and a go field. The larger STOP field is at the bottom of the display face and has a red background. The DANGER field is located above the STOP field and has a yellow background. The go field is located above the DANGER field and has a green background. Each display face may further include a street name, as well as other optional features that significantly promote intersection safety.

20 Claims, 6 Drawing Sheets

HIGHWAY INTERSECTION HAZARD WARNINGS AND TRAFFIC CONTROL SYSTEM, AND METHOD OF APPLYING SAME

BACKGROUND OF THE INVENTION

1. Field of the Invention

The present invention is a system that integrates hazard warning signals and a traffic control system to reduce vehicle and pedestrian collisions, injuries, and deaths at highway intersections by improving safe traffic flow through intersections, and also a method of applying the system. More particularly, the present invention relates to a hazard warnings and traffic signal system that combines bold color symbols with simple word indicia in a plurality of fields on a large, clear display panel, and which enlarges all signals, particularly the red STOP signal, and places it at the bottom of the display panel, closest to the center of the driver's visual field. The invention incorporates principles of modern human factors science, safety engineering, hazard warnings, and ergonomics.

2. Background

The most dangerous machines that most people regularly encounter are automobiles and trucks. People encounter these machines as drivers, passengers, and pedestrians. Vehicle driving combines the highest-level visual tasks with the highest-level risks that most people encounter.

Drivers must be vigilant and aware of their surroundings while operating vehicles, but often, they are not. People cannot be 100 percent vigilant 100 percent of the time. Anything that promotes vigilance to hazardous situations promotes safety. Examples of behaviors that distract drivers include adjusting the radio, using cell phones, picking up items, lighting cigarettes, searching for street signs, tending to children and pets, reading newspapers or other material, eating and drinking, and studying maps. Drivers may become drowsy, weave, fall asleep, eat, drive while intoxicated, and drive at excessive speeds. Still other drivers may stop needlessly and abruptly, apply makeup, run red lights, shave, brush or comb hair, brush their teeth, ogle and flirt with those in other vehicles, gargle, or engage in other types of distracted driving.

Highways have increasingly abundant visual clutter competing for the driver's attention, including colorful advertising, signage, compound traffic signals at a given location, pedestrians, other vehicles, and multiple road signs. Such distractions are typically at highway intersections where drivers must be highly vigilant for people, vehicles, and signals. There is one death and 114 life-altering injuries every hour in the United States at traffic intersections. Traffic safety engineers maintain that intersection deaths and injuries can be substantially reduced by improvements to intersection traffic light systems.

Highway traffic warning signals are virtually the same since first designed and installed in the early 1920s. The existing three-color traffic warning signal was not designed on scientific principles.

Existing three-color traffic warning signals fail because they:

- are diversely scattered and inconsistently located,
- exclude key safety information needed by motorists,
- locate the most important warning signal farthest from the driver's anatomically neutral visual field,
- are ineffective for color-blind and color-perceptive deficient persons,
- are too small and do not exhort hazards that compel safe driving,
- introduce unnecessary distracting visual clutter,

- do not comport with current human factors knowledge, visual field confliction, and our aging population, and
- are not designed based on human factors experience, ergonomics, modern safety engineering principles, and standard-of-care warnings technology.

There has been some focus on pedestrian markings, bump and rumble strips, guard rails, roundabouts, street lighting, visibility, speed limits, signage, divided highways, pedestrian islands, and other highway safety engineering. Yet, in spite of these improvements, thousands of people continue to lose their lives yearly in the United States at highway intersections with and without three-color hazard warning control systems.

Over 85 years, traffic safety engineers have not rigorously, robustly studied the effectiveness of intersection warning signals to prevent deaths, life-altering injuries, and property damages. Traffic signal devices need modernization to meet the current level of knowledge of warnings, human factors, multi-stimuli recognition and response, ergonomics, and modern safety engineering principles.

As shown in FIG. 6 of the Drawings, in an intersection of the type where two four-lane highways cross at right angles to one another, it is conventional to use eight conventional traffic signals, with an individual signal for the on-coming traffic in each lane, plus four pedestrian crossing signals at the respective corners of the intersection. This conventional approach provides excessive visual clutter to a driver, particularly when combined with billboards, objects, and other signage. The present eight signals can be reduced to four, and, in some circumstances, to one.

The history of personal injuries occurring as a result of traffic collisions is horrid and preventable. Collisions between vehicles at traffic intersections cause:

1. Numerous foreseeable premature deaths.
2. Numerous foreseeable serious life-altering injuries.
3. Substantial foreseeable property damage.
4. Significant emotional distress for relatives, friends of decedents, and injured persons.
5. Substantial costs to society (emergency response, medical, long-term care, civil and criminal infractions, fines, imprisonments, litigation claims, property repairs, etc.).
6. Increases in insurance premiums.

The following facts, regarding collisions which occur at traffic intersections in the United States, are provided by the National Safety Council and the Federal Highway Administration.

- "Intersection crashes account for over 45% of all reported collisions and 21% of highway fatalities." 2004 total highway fatalities=42,836.
- "In 2003, 9213 Americans died in intersection crashes. In 2004, 9117 died in intersection crashes." This exceeds one intersection death every hour.
- "Reducing intersection crashes is key to reducing roadway death toll."
- "In urban areas, collisions on arterial roads account for over two-thirds of fatalities. Red light running is the leading cause of urban crashes. Better intersection design will reduce incidence of human errors."
- Approximately 3,000,000 intersections exist in the U.S., excluding neighborhoods.
- Approximately 2,700,000 intersections do not have illuminated signals.
- Approximately 265,000 major intersections have illuminated signals.
- Approximately 2,500,000 intersection crashes are reported annually.
- Approximately 1,000,000 reported intersection crashes resulting in injuries are reported annually. This exceeds 114 injuries every hour. Complications from such vehicle collisions include permanent vegetative states, quadriplegia, burns, loss of limbs, blindness, disfigurement, etc.

From 2002 to 2004, there was a 4.2% (357) increase in intersection fatalities.

We must we do more to prevent deaths, injuries, and damage from these encounters.

A number of different traffic signaling devices are known. Examples of some of the known traffic signaling devices include those described in U.S. Pat. No. 3,983,532 (Hayes), U.S. Pat. No. 5,517,395 (Weissman), U.S. Pat. No. 5,838,260 (Liu), U.S. Pat. No. 6,072,407 (Shin), U.S. Pat. No. 6,762,689 (Dechape), U.S. Pat. No. 6,943,698 (Jones et al), and United States Patent Application 2006/0022838 (Fisher).

Although the known signaling devices are usable for their intended purposes, a great need still exists in the art for an improved traffic signaling system. In particular, there is a need for an improved traffic signaling system which will promote improved safety at intersections, and will overcome difficulties encountered with the known art. To communicate the dangers of intersection hazards and to provide reasonable safety instructions, stronger warnings are necessary to grab and hold the attention of drivers to promote safe behavior.

SUMMARY OF THE INVENTION

Accordingly, an objective of the present invention to provide a traffic signaling method and system for improving safety at highway traffic intersections. Another objective of the present invention is to provide a traffic signaling method and system which will reduce deaths, injuries, and property damage. Improving warning signals at intersections and other traffic locations will also reduce social costs; prevent family and loved ones' grief; foster safer, saner highway traffic society; reduce visual clutter; and promote standardization of traffic intersection warning signals.

A traffic signal system according to the present invention may be used to replace multiple poor warning signals with one that is brighter, bolder, and includes blinking signals of larger lights. A traffic signal system according to the present invention may include the name of a cross street. A traffic signal system according to the present invention may include words, numbers and/or other indicia, to display the applicable speed limit and to aid color-blind or color-deficient persons. A traffic signal system according to the present invention inverts and enlarges the red STOP signal with the green proceed signal, as compared to known signal devices currently in use.

When installed in a street intersection, a traffic signal system according to the present invention places the traffic signal nearer to the center of the driver's visual field, as compared to current traffic intersection signal devices.

One exemplary embodiment of a traffic signal system consistent with the present invention follows, and this example is intended to illustrate, rather than to limit the invention.

The basic platform of the system includes a hollow housing formed in a cube measuring 44 inches by 44 inches by 44 inches.

The visual signage dimensions, in this platform, are 42 inches by 42 inches on four identical panels. The panels are translucent to transmit light from lamps inside the housing.

The housing includes easy-access hinged doors. LED and/or carbon nanotube lamps and a street name sign are provided inside the housing. The street name sign may be computer programmed or pre-printed.

Each panel includes a green speed limit proceed signal=8"×42"=336 in$^2$.

Each panel includes a yellow DANGER signal=11"×42"=462 in$^2$.

Each panel includes a red STOP signal=16"×42"=672 in$^2$.

The red signal area is twice the area of the green signal, and the yellow signal is larger than the green signal.

The signal can be installed with a dual intersecting cable suspension system that minimizes swinging and swaying of the signal system in adverse weather and, at the same time, reduces likelihood of the signal system falling on vehicles. The suspension cables may be colored sky blue or gray to reduce visual interference and conflict. The signal cube can be installed on conventional over-arching poles.

Warnings and instruction panels can be attached as necessary (e.g., "One Way", "No Left Turn", "School Zone", "Street Flooded-Detour").

The system provides improved line-of-sight visibility by the use of large white STOP text on the red background signal.

A traffic signal system according to an embodiment of the invention is very flexible and can be formatted many ways, e.g., at late night, the warnings can be altered when the traffic density is less. The speed limits, likewise, can be changed as indicated for traffic safety.

A traffic signal system according to an embodiment of the present invention provides substantially larger signal warning lights than the current traffic signal control system. This promotes safer driving behavior.

A traffic signal system according to an embodiment of the present invention includes clear safety instructions and unambiguous hazard warnings.

A traffic signal system according to an embodiment of the present invention provides cross-street information. This increases driver's focus on the intersection and reduces distractive looking for sign locations often at high rates of speed.

A traffic signal system according to an embodiment of the present invention places key information in a central visual cluster for the driver's easy review and improved recognition.

A traffic signal system according to an embodiment of the present invention provides improved safety guidance for color-blind and color-perception disadvantaged persons. Color alone does not aid the color-blind and color-perception deficient person.

When installed at a traffic intersection, a traffic signal system according to an embodiment of the present invention reduces visual clutter and distractions, as compared to the conventional arrangement of traffic signals and other signs.

Unlike the conventional signal control system, a traffic signal system according to an embodiment of the present invention meets current practices of human factors, warnings, ergonomics, and highway safety engineering.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

It should be understood that only structures considered necessary for clarifying the present invention are described herein. Other conventional structures, and those of ancillary and auxiliary components of the system, are assumed to be known and understood by those skilled in the art.

Figure 1:
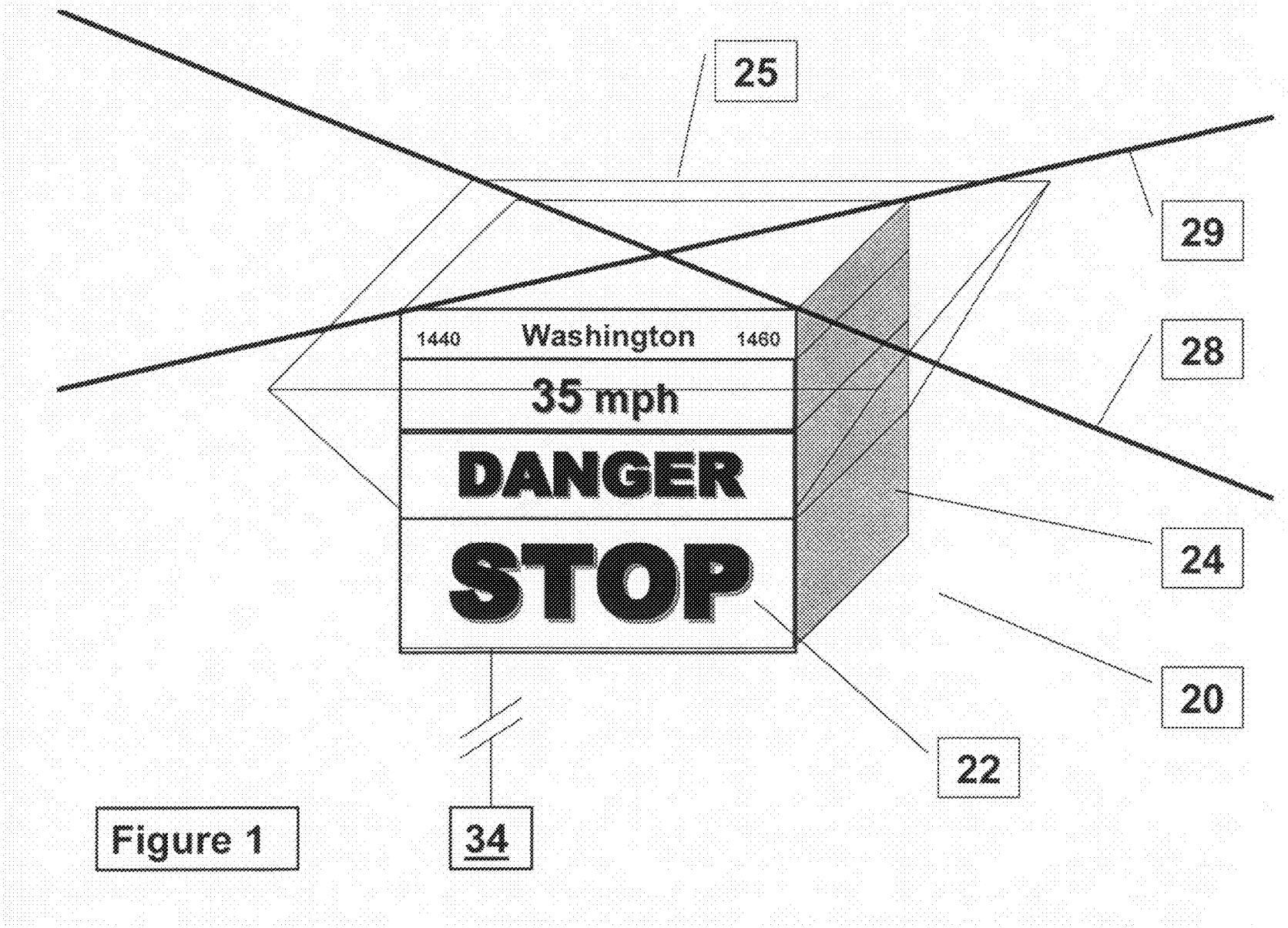
FIG. 1 is a perspective view of a hazard warning and traffic control system according to a selected illustrative embodiment of the present invention.
Figure 2:
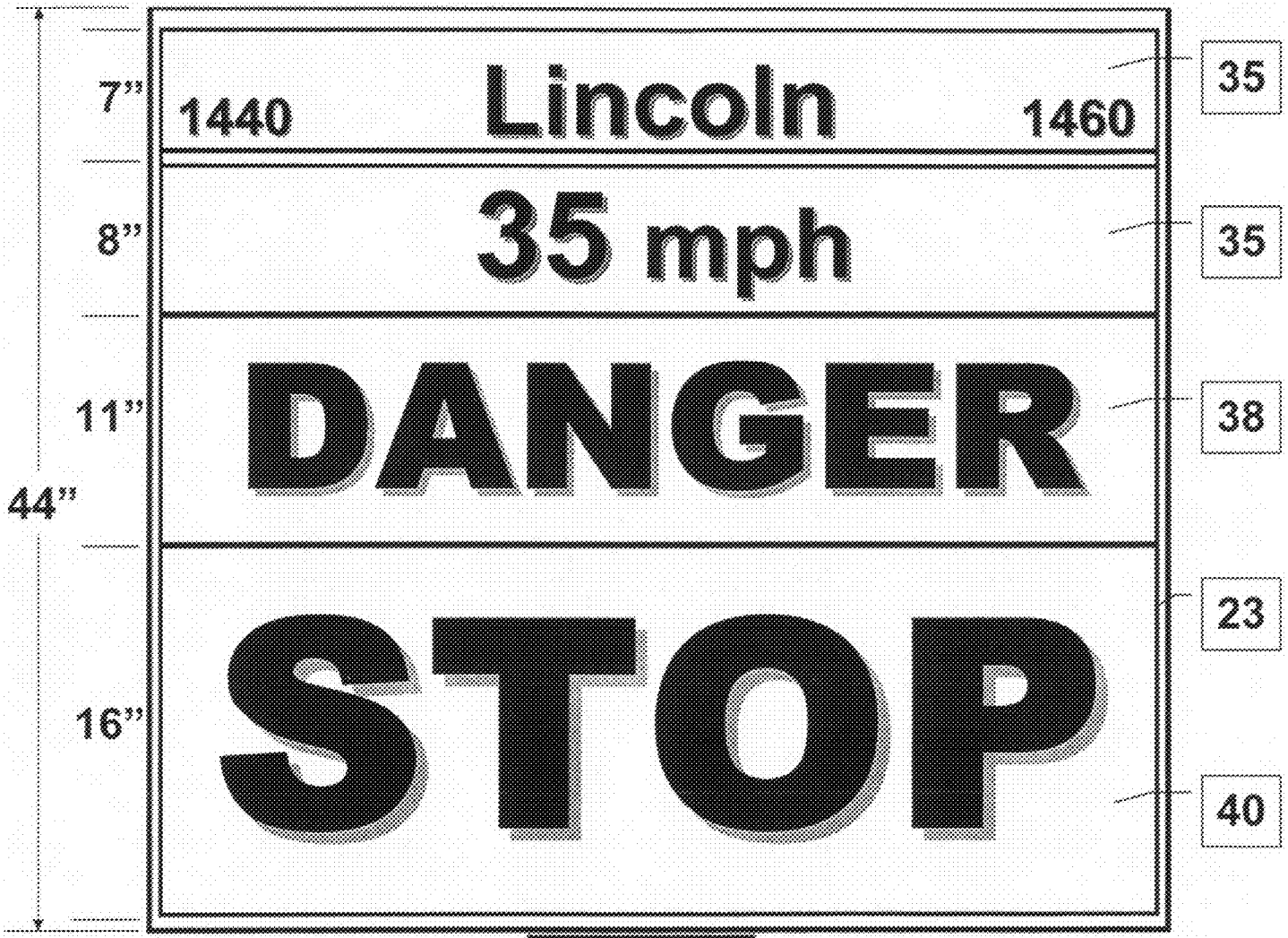
FIG. 2 is a side plan view showing a single display face of the hazard warning and traffic control system of FIG. 1.
Figure 3:
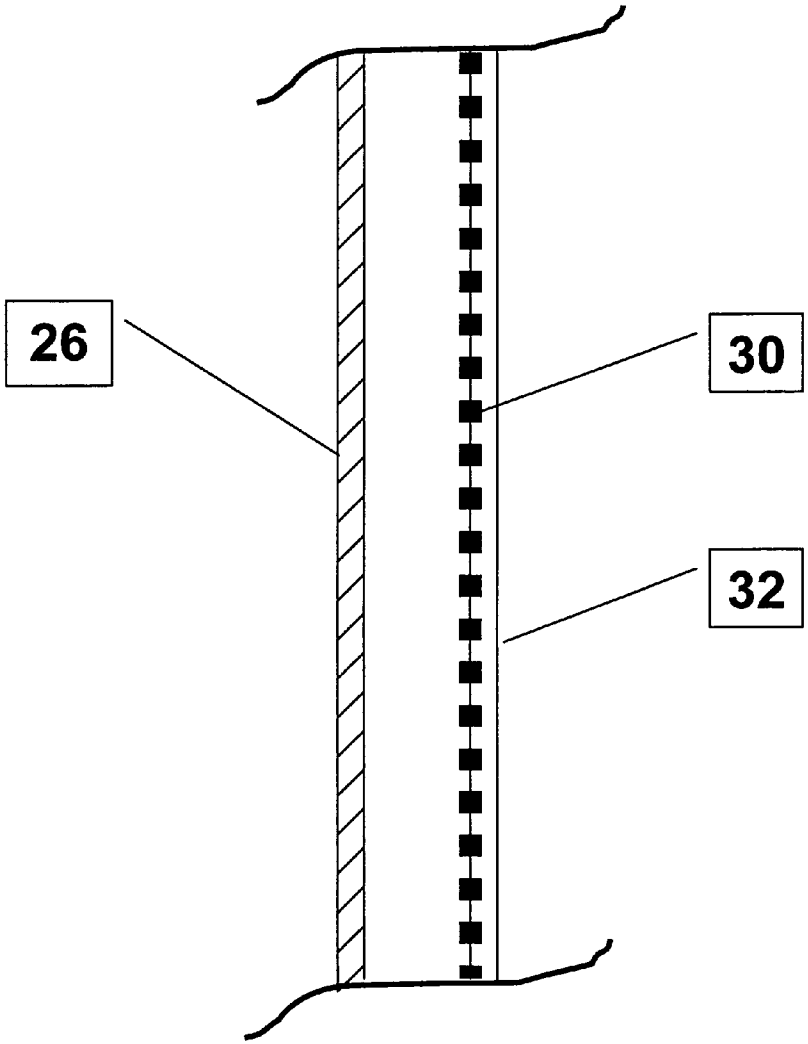
FIG. 3 is a detail cross-sectional view showing a portion of the hazard warning and traffic control system of FIGS. 1-2.
Figure 6:
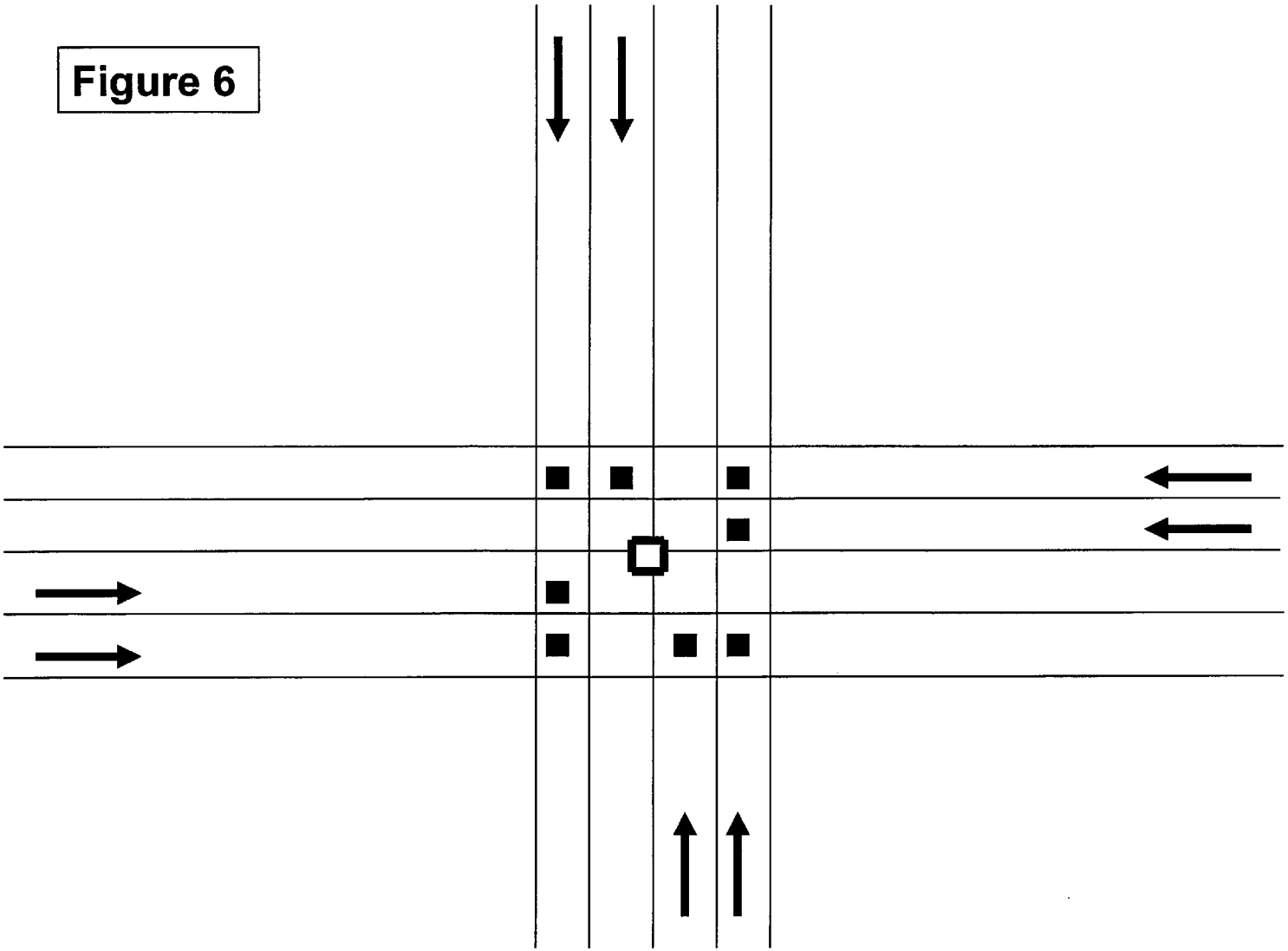
FIG. 6 is a birds-eye plan view of a traffic intersection, showing locations of both prior art signals and the hazard warning and traffic control system according to the invention. The configuration in FIG. 6 can be modified to apply four signals to replace eight.

Referring now to FIGS. 1-3 of the drawings, a traffic signal and hazard warning system 20, according to a first illustrative embodiment of the present invention, will now be described. A single system 20 according to the present invention is intended to be placed centrally in an intersection so as to be viewable by all vehicular traffic, as indicated by the centrally located square box in the intersection depicted in FIG. 6.

The system 20 includes a housing 22 formed in a rectangular box shape. In one illustrative embodiment, the housing 22 is a cube measuring approximately 44 inches by 44 inches by 44 inches.

The housing 22 may be provided with vents on the bottom and top thereof, to permit convective heat transfer to surrounding air by chimney effect ventilation. In one embodiment, portions of the housing 22 may be white in color, made from a polymer or copolymer such as polycarbonate plastic with a titanium dioxide or zinc oxide filler. The housing 22 may be provided with rigid plastic or stainless steel needles on top to discourage bird roosting and rodent pathways. The housing 22 may include an electrical conduit fitting on the top thereof, to permit mounting of an electronic speed detection monitor and camera thereon.

Each vertically-oriented side of the housing 22 includes a display face 24 facing outwardly towards oncoming traffic. At a normal intersection where two two-way streets intersect, four separate display faces will be needed. Alternatively, at an intersection where two one-way streets intersect, only two operating display faces may be needed. The housing 22 includes a one-inch bright reflective outer white border 23 surrounding each of the display faces 24, as shown in FIG. 2. Larger reflective borders can be installed.

The housing 22 has a shield member 25 mounted thereon to reduce glare, and offer protection from rain, sleet, snow, and ice.

The visual signage dimensions, in this example, are 42 inches by 42 inches on four identical display panels 26. The panels 26 are translucent or transparent, in order to transmit light outwardly from lamps 30 inside of the housing 22. The lamps 30 may be provided as light-emitting diodes (LEDs), as illuminatable carbon nanotubes, or as combinations of these lights or other illumination sources.

When installed at a specific intersection, the signal system 20 may be provided with a dual intersecting cable suspension system, including a first cable 28 and a second cable 29. If desired, each of the cables 28, 29 may be attached to the top of the housing at two or more points of attachment, in order to provide added stability. The dual intersecting cable suspension system, where used, minimizes swinging and swaying of the signal system 20, and at the same time, reduces likelihood of the signal system falling on vehicles. The suspension cables 28, 29 may be colored sky blue or gray to reduce visual interference and visual conflict.

The housing 22 includes a hinged door on the bottom surface thereof, to provide easy access to the interior thereof for maintenance personnel. The lamps 30 and an optional street name sign are provided inside of the housing. The street name sign may be computer programmed or pre-printed. The lamps 30 are mounted on a circuit board 32, which is controlled by an electronic controller 34 including a timer. The lamps 30 and circuit board 32 cooperate to form a display face 24.

The controller 34 may be provided inside of the housing, or may be placed separately outside of the housing 22 in a control box (not shown) which is in electrical communication with the housing. Where used, this control box may be placed closer to street level than the housing 22, if desired, in order to allow maintenance personnel to modify or update the controller 34.

Referring to FIG. 2, it will be seen that each of the display faces 24 includes a number of discrete fields of different relative sizes. The controller 34 is able to selectively and sequentially power the different fields of the display faces, as needed, for predetermined time intervals, in a manner similar to the operation of conventional traffic signal devices. In the embodiment of FIGS. 1-2, the display faces 24 each include the following fields.

If desired, each of the display faces 24 may include an upper cross street field 35, which may include indicia naming the appropriate cross street, and may also include numeric indicia at each end thereof, as shown, corresponding to the range of street numbers in the vicinity.

Each of the display faces 24 includes an elevated green speed limit proceed signal field ("go field") 36, which may also display indicia corresponding to a speed limit, when lit. In this example, the go field 36 is 8"×42"=336 square inches.

Each of the display faces 24 also includes a medial yellow DANGER signal field (slow, prepare to stop field) 38, which may also display lettering to warn drivers to notify danger. In this example, the slow field 38 is 11"×42"=462 square inches.

Each of the display faces 24 further includes an enlarged lower red STOP signal field (stop field) 40. In this example, the slow field is 16"×42"=672 square inches.

The system 20 according to the illustrative embodiment of the invention provides improved line-of-sight visibility by the use of large white STOP text on the red background signal in the stop field 40.

The area of the red signal field 40 is twice the area of the green signal field 36.

The area of the largest conventional 12" diameter signal is 113.1 square inches.

Therefore, signal color areas increase 3.0 (green), 4.1 (yellow), and 5.9 times (red), respectively, over the conventional maximum size (12") traffic signal. Eight-inch diameter conventional signals have, accordingly, considerably reduced signal area compared to the invention.

Figure 4:
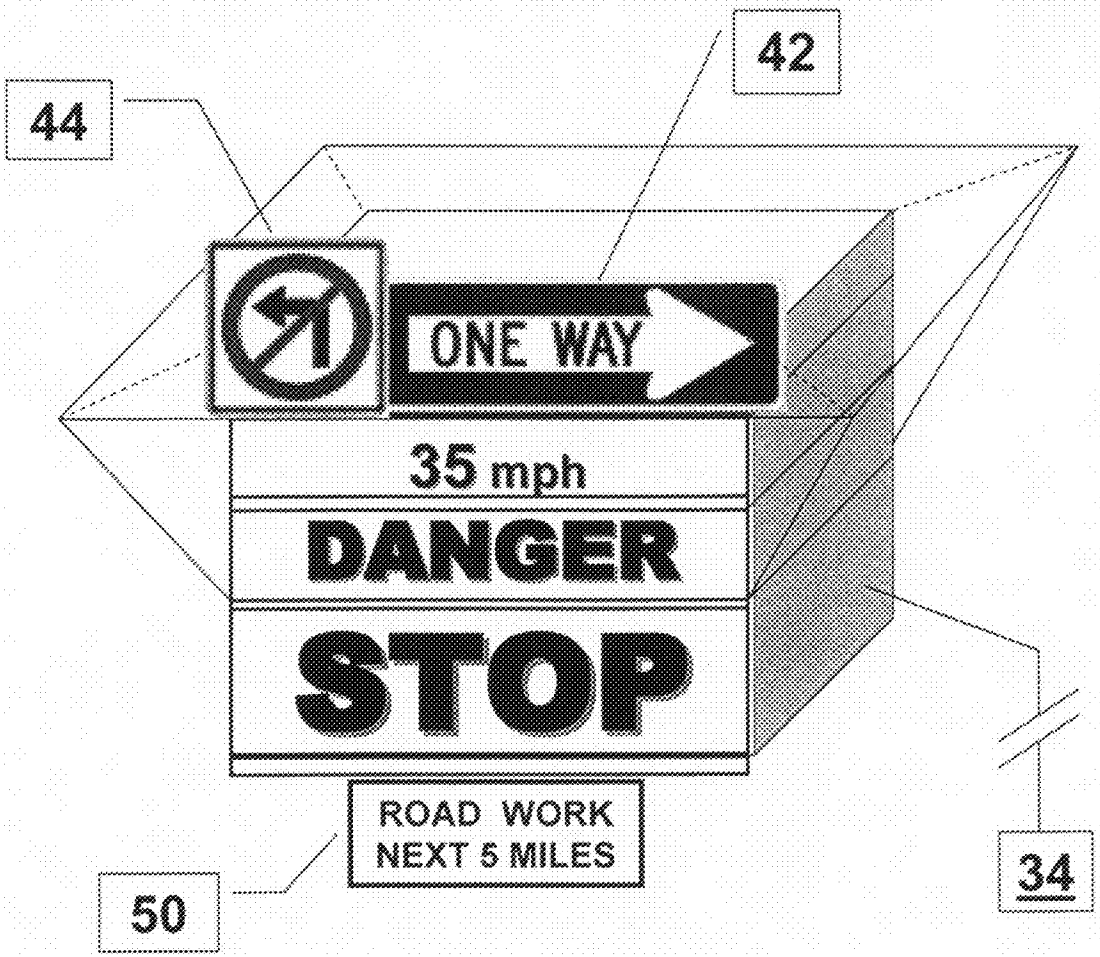
FIG. 4 is a perspective view of a hazard warning and traffic control system according to the present invention, modified to include a drop-down panel and additional signage.

Referring now to FIG. 4, it will be seen that additional warning signs and/or instruction panels can, optionally be attached as necessary or desired (e.g., "One Way" 42, "No Left Turn" 44, a strobe light 46 on top for emergencies, "School Zone", etc).

An optional drop-down display panel 50 can be made to deploy from the housing by the controller, if needed, to display scrolling or static messages about changing conditions, such as "Road Work Ahead" or "Street Flooded—Detour." The message displayed by the drop-down display panel 50 may be variable, and the use and display thereof is controlled by the controller 34. Movement of the drop-down display panel 50 may be controlled by the controller 34 using an electric motor (not shown) installed in the housing 22.

The signal system 20 may be used in conjunction with known traffic density sensors (not shown) buried beneath the street surface, where the controller 34 is able to access signals output by the traffic sensors to assess traffic density in different directions, and to regulate timing of the signals activated on the display faces, commensurate with traffic density.

Figure 5:
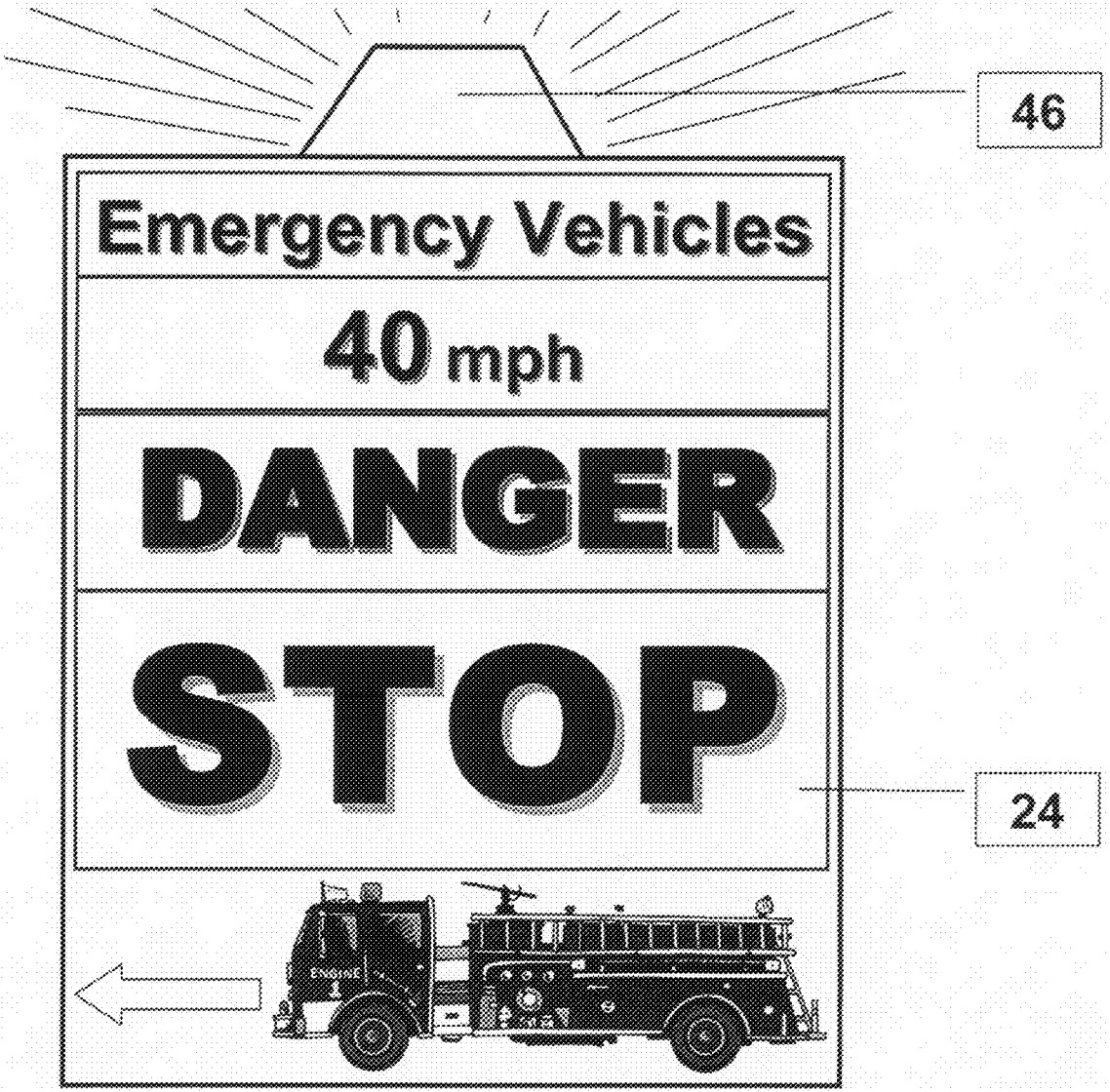
FIG. 5 is a side plan view of a display face of the hazard warning and traffic control system hereof, modified to permit passage of an emergency vehicle.

As shown in FIG. 5, the system 20 may be overridden by public safety officials in case of emergency, to display a message indicating that all normal vehicle traffic must allow passage of police, fire, ambulance, or other emergency vehicles.

Controller 34 may include a wireless communication device to allow for software upgrading and modification by authorized personnel.

Although the present invention has been described herein with respect to a number of specific illustrative embodiments, the foregoing description is intended to illustrate, rather than to limit the invention. Those skilled in the art will realize that many modifications of the preferred embodiment could be made which would be operable. All such modifications, which are within the scope of the claims, are intended to be within the scope and spirit of the present invention.

Having, thus, described the invention, what is claimed is:

1. A hazard warning and traffic control system, comprising:

a housing having at least two display faces oriented at an angle relative to one another, each of said display faces containing a plurality of fields, wherein each of said fields comprises a plurality of illuminating members, and each of said fields displays indicia and is independently and selectively illuminated; and an electronic controller in electrical communication with said housing for selectively illuminating said illuminating members to selectively control an instantaneous display on each of said display faces, said controller comprising a timer;

wherein one of said fields in each of said display faces is a STOP warning field and is adapted to display a STOP message with a red background when illuminated;

wherein an intermediate DANGER field in each of said display faces is disposed above said STOP field and is adapted to display a message with a yellow background when illuminated;

and wherein an elevated go field in each of said display faces is located above said intermediate field and is adapted to display a proceed message with a green background and speed limit when illuminated.

2. The system of claim 1, wherein the controller is selectively operable to cause one or more of the fields on each display face to blink on and off when activated.

3. The system of claim 1, further comprising one or more additional auxiliary signs operatively attached to said housing to indicate a specific traffic condition.

4. The system of claim 1, wherein said illuminating members comprise LEDs.

5. The system of claim 1, wherein said illuminating members comprise carbon nanotubes.

6. The system of claim 1, wherein said go field is adapted to display speed limit indicia.

7. The system of claim 1, wherein each of said display faces comprises a street indicator field adapted to display a cross street intersection name.

8. The system of claim 1, further comprising a weather and glare shield attached to an upper portion of the housing.

9. The system of claim 1, further comprising a dropdown panel adapted to display a changeable message as instructed by the controller.

10. The system of claim 1, wherein the go field, the DANGER field and the STOP field each include both word indicia and color symbols and blinking capability.

11. The system of claim 1, wherein the STOP field is larger in area than either of the DANGER field or the go field.

12. A hazard warning and traffic control system, comprising:

a substantially cube-shaped housing having four substantially vertical display faces thereon, each of said display faces containing a plurality of fields, wherein each of said fields comprises a plurality of illuminating members, and each of said fields displays indicia and is independently and selectively illuminated; and an electronic controller in electrical communication with said housing for selectively illuminating said illuminating members to selectively control an instantaneous display on each of said display faces, said controller comprising a timer;

wherein one of said fields in each of said display faces is a STOP warning field and is adapted to display a STOP message with a red background when illuminated;

wherein an intermediate caution field in each of said display faces is disposed above said STOP warning field and is adapted to display a DANGER message with a yellow background when illuminated;

wherein an elevated go field in each of said display faces is disposed above said intermediate field and is adapted to display a go message with a green background when illuminated;

wherein the go field, the DANGER field and the STOP field each include both word indicia and color symbols;

and wherein an upper message field in each of said display faces is adapted to display a street name when illuminated.

13. The system of claim 12, further comprising one or more additional auxiliary signs operatively attached to said housing to indicate a specific traffic condition.

14. The system of claim 12, wherein said illuminating members comprise LEDs.

15. The system of claim 12, wherein said illuminating members comprise carbon nanotubes.

16. The system of claim 12, wherein said go field is adapted to display speed limit indicia.

17. The system of claim 12, further comprising a weather and glare shield attached to an upper portion of the housing.

18. The system of claim 12, further comprising a dropdown panel adapted to display a changeable message as instructed by the controller.

19. The system of claim 12, wherein the go field, the DANGER field and the STOP field each include both word indicia and color symbols.

20. The system of claim 12, wherein the STOP field is larger in area than either of the DANGER field or the go field.

* * * * *